US005500320A

United States Patent [19]

Saha

[11] Patent Number: 5,500,320

[45] Date of Patent: Mar. 19, 1996

[54] HIGH SPEED DEVELOPER COMPOSITIONS WITH FERRITE CARRIERS

[75] Inventor: Bijay S. Saha, Rochester, N.Y.

[73] Assignee: Eastman Kodak Company, Rochester, N.Y.

[21] Appl. No.: 297,462

[22] Filed: Aug. 29, 1994

[51] Int. Cl.[6] ..... G03G 9/107

[52] U.S. Cl. ..... 430/106.6; 430/108; 430/111; 252/62.63

[58] Field of Search ..... 430/106.6, 108, 430/111

[56] References Cited

U.S. PATENT DOCUMENTS

| | | | |
|---|---|---|---|
| 3,716,630 | 2/1973 | Shirk | 423/594 |
| 4,042,518 | 8/1977 | Jones | 252/62.6 |
| 4,473,029 | 9/1984 | Fritz et al. | 430/122 |
| 4,546,060 | 10/1985 | Miskinis et al. | 430/108 |
| 4,623,603 | 11/1986 | Iimura et al. | 430/108 |
| 4,764,445 | 8/1988 | Miskinis et al. | 430/108 |
| 4,855,205 | 8/1989 | Saha et al. | 430/106.6 |
| 4,855,206 | 8/1989 | Saha et al. | 430/106.6 |
| 5,061,586 | 10/1991 | Saha et al. | 430/108 |
| 5,104,761 | 4/1992 | Saha et al. | 430/106.6 |
| 5,106,714 | 4/1992 | Saha et al. | 430/106.6 |
| 5,190,842 | 3/1993 | Saha et al. | 430/106.6 |
| 5,268,249 | 12/1993 | Saha et al. | 430/106.6 |

*Primary Examiner*—Roland Martin
*Attorney, Agent, or Firm*—Willard G. Montgomery

[57] ABSTRACT

Carrier particles for an electrostatographic developer comprising particles of a hard, magnetic ferrite material having a hexagonal crystalline structure of the general formula MO.6 $Fe_2O_3$ in which M is strontium, barium or mixtures thereof exhibiting a coercivity of at least 300 Oersteds when magnetically saturated and an induced magnetic moment of at least 20 EMU/g when in an applied magnetic field of 1000 Oersteds and having a number average particle diameter of from 10.0 to 38.0 micrometers.

The carrier particles provide developer compositions for magnetic brush development having high development speeds without the loss of copy image quality.

5 Claims, 1 Drawing Sheet

HIGH SPEED DEVELOPER COMPOSITIONS WITH FERRITE CARRIERS

FIELD OF THE INVENTION

The present invention relates generally to the field of electrostatography and to the development of electrostatic images. More particularly, the present invention relates to hard ferrite magnetic carrier particles and developers used for the dry development of electrostatic images.

BACKGROUND OF THE INVENTION

In electrography, an electrostatic charge image is formed on a dielectric surface, typically the surface of a photoconductive recording element or photoconductor. Development of this image is commonly achieved by contacting it with a dry, two-component developer comprising a mixture of pigmented resinous electrically insulative particles known as toner, and magnetically attractable particles, known as carrier. The carrier particles serve as sites against which the non-magnetic toner particles can impinge and thereby acquire a triboelectric charge opposite to that of the electrostatic image. The toner particles are held on the surface of the relatively larger-sized carrier particles by the electric force generated by the friction of both particles as they impinge upon and contact one another during mixing interactions. During contact between the electrostatic image and the developer mixture, the toner particles are stripped away from the carrier particles to which they had formerly adhered (via triboelectric forces) by the relatively strong attractive force of the electric field formed by the charge image which overcomes the bonding forces between the toner particles and the carrier particles. In this manner, the toner particles are attracted by the electrostatic forces associated with the charge image and deposited on the electrostatic image to render it visible.

It is known in the art to apply developer compositions of the above type to electrostatic images by means of a rotating-core magnetic applicator which comprises a cylindrical developing sleeve or shell of a non-magnetic material having a magnetic core positioned within. This particular type of development is commonly referred to in the art as magnetic brush development. The core usually comprises a plurality of parallel magnetic strips which are arranged around the core surface to present alternative north and south magnetic fields. These fields project radially, through the sleeve, and serve to attract the developer composition to the sleeve's outer surface to form a brush nap, or what is commonly referred to in the art as, a "magnetic brush." It is essential that the magnetic core be rotated during use to cause the developer to advance from a supply sump to a position in which it contacts the electrostatic image to be developed. The cylindrical sleeve, or shell, may or may not also rotate. If the shell does rotate, it can do so either in the same direction as or in a different direction from the core. After development, the toner depleted carrier particles are returned to the sump for toner replenishment. The role of the carrier is (a) to transport the toner particles from the sump to the magnetic brush, (b) to charge the toner by triboelectrification to the desired polarity, i.e., a polarity opposite that of the charge of the electrostatic image on the photoconductive recording element or plate and (c) to charge the toner to the proper or desired degree (amount) of charge. The magnetic carrier particles, under the influence of the magnets in the core of the applicator, form fur-like hairs or chains extending from the developing sleeve or shell of the applicator. Since the charge polarity of the magnetic carrier is the same as that of the electrostatic image, the magnetic carrier is left on the developing sleeve of the applicator after the toner particles have been stripped away from the carrier during development of the electrostatic or charge image. Typically, a bias voltage is applied between the photosensitive material or plate and the developing sleeve of the magnetic applicator by means of an electric current externally applied to the developing sleeve or shell which flows through the magnetic brush. The purpose of the bias voltage primarily is to prevent, or at least substantially reduce, the occurrence of unwanted toner fogging or background development caused by the migration of a certain portion of the toner particles available for development from the carrier to a non-image area or portion of the photosensitive plate (or drum) during development due to an incomplete discharge of such nonimage areas during exposure. Commonly referred to as background charge, these areas of incomplete discharge cause an attraction for and a migration of some of the available toner particles (particularly those toner particles possessing an insufficient quantity of charge) to the partially discharged areas during development which results in the development or coloration of areas of the electrostatic image pattern that should not be developed. The polarity of the bias voltage should be the same as the charge polarity of the photosensitive material. That is, if the charge polarity of the photosensitive material or plate is positive, a positive polarity is selected for the bias voltage. Caution muse be exercised in selecting the proper amount of bias voltage applied between the photosensitive material and the developing sleeve so that problems such as discharge breakdown are not caused in the photosensitive material or the magnetic brush or that toner migration of the toner particles from the carrier to the electrostatic image to be developed is not prevented due to the application of a disproportionate or excessive amount of bias voltage to the magnetic brush during development. Ordinarily, it is typical that the bias voltage be controlled to about 25 to 300 volts, particularly about 150 to 250 volts.

Conventionally, carrier particles made of soft magnetic materials have been employed to carry and deliver the toner particles to the electrostatic image. More recently, hard magnetic materials have been used to carry and deliver the toner particles to the electrostatic image. For example, U.S. Pat. Nos. 4,546,060 to Miskinis et al, and 4,473,029 to Fritz et al, teach the use of hard magnetic materials as carrier particles and an apparatus for the development of electrostatic images utilizing such hard magnetic carrier particles, respectively. These patents require that the carrier particles comprise a hard magnetic material exhibiting a coercivity of at least 300 Oersteds when magnetically saturated and an induced magnetic moment of at least. 20 EMU/g when in an applied magnetic field of 1000 Oersteds. The terms "hard" and "soft" when referring to magnetic materials have the generally accepted meaning as indicated on page 18 of *Introduction to Magnetic Materials* by B. D. Cullity published by Addison-Wesley Publishing Company, 1972. These hard magnetic carrier materials represent a great advance over the use of soft magnetic carrier materials in that the speed of development is remarkably increased without experiencing deterioration of the image. Speeds as high as four times the maximum speed utilized in the use of soft magnetic carrier particles have been demonstrated.

The above two mentioned U.S. patents, while generic to all hard magnetic materials having the properties set forth, prefer the hard magnetic ferrites which are compounds of barium and/or strontium such as, $BaFe_{12}O_{19}$ and $SrFe_{12}O_{19}$. While these hard ferrite carrier materials provide for increased development speeds, it is desired that, even further improvements be made with respect to further increasing development speed using these ferrite carrier materials. It is toward this objective that the present invention is directed.

It has now been discovered that by limiting the particle size of these particular ferrite carrier materials to particles having a number average particle diameter of from about 10.0 to about 38.0 micrometers, that developer compositions comprising such carrier particles and oppositely charged toner particles exhibit development speeds of from 1.5 to 2.5 times faster than those of conventional developer compositions comprising carrier particles having a typical particle size distribution of from about 1.0 to about 60.0 micrometers and oppositely charged toner particles. That is, in the conventional carrier manufacturing process for producing strontium and barium ferrite carrier particles, powders of ferric oxide (i.e., $Fe_2O_3$) and the oxides of barium or strontium or a salt of barium or strontium convertible to the oxide by heat, such as the carbonates, sulfates, nitrates or phosphates of barium or strontium, are mixed together in a predetermined ratio, typically from about 4 to 6 moles of $Fe_2O_3$ per 1 mole of the metal oxide or metal oxide-forming salt and then mixed with a solution of an organic binder, such as guar gum, and a polar solvent, preferably water. The solution is then ball milled into a liquid slurry and spray dried to form unreacted, non-magnetic, dried green beads. The green beads are then subsequently fired at high temperatures, generally ranging from about 900 to 1500° C. to form the magnetic carrier particles typically having a number average particle size distribution of from about 1.0 to about 100.0 micrometers, and more typically a number average particle size distribution of from about 1.0 to about 60.0 micrometers. This particular method of carrier particle manufacture is commonly referred to as the spray-drying method of manufacture. It has been found, however, that instead of forming developer compositions by simply mixing the carrier particles as they are obtained from the spray drying process having a particle size distribution of from about 1.0 to about 60.0 micrometers (number average particle diameter) with oppositely charged toner particles and using such developer compositions to develop electrostatic images in a copying appartus, that if only that fraction of the carrier particles having a number average particle diameter of from 10.0 to 38.0 micrometers is used in forming a developer composition, that such developer compositions can increase development speed by as much as 1.5 to 2.5 times over that of a conventional developer composition comprising the same carrier particles having a typical particle size distribution of from 1.0 to 60.0 micrometers and the same toner particles having the same composition and electrical charge value.

SUMMARY OF THE INVENTION

Thus, in accordance with the present invention, there is provided, as a carrier for an electrostatographic developer composition, particles of a hard magnetic ferrite material having a hexagonal crystalline structure of the general formula $MO.6Fe_2O_3$ in which M is strontium, barium or mixtures thereof exhibiting a coercivity of at least: 300 Oersteds when magnetically saturated and an induced magnetic moment of at least 20 EMU/g when in an applied magnetic field of 1000 Oersteds and having a number average particle diameter of from 10.0 to 38.0 micrometers.

DESCRIPTION OF THE PREFERRED EMBODIMENTS

Figure 1:
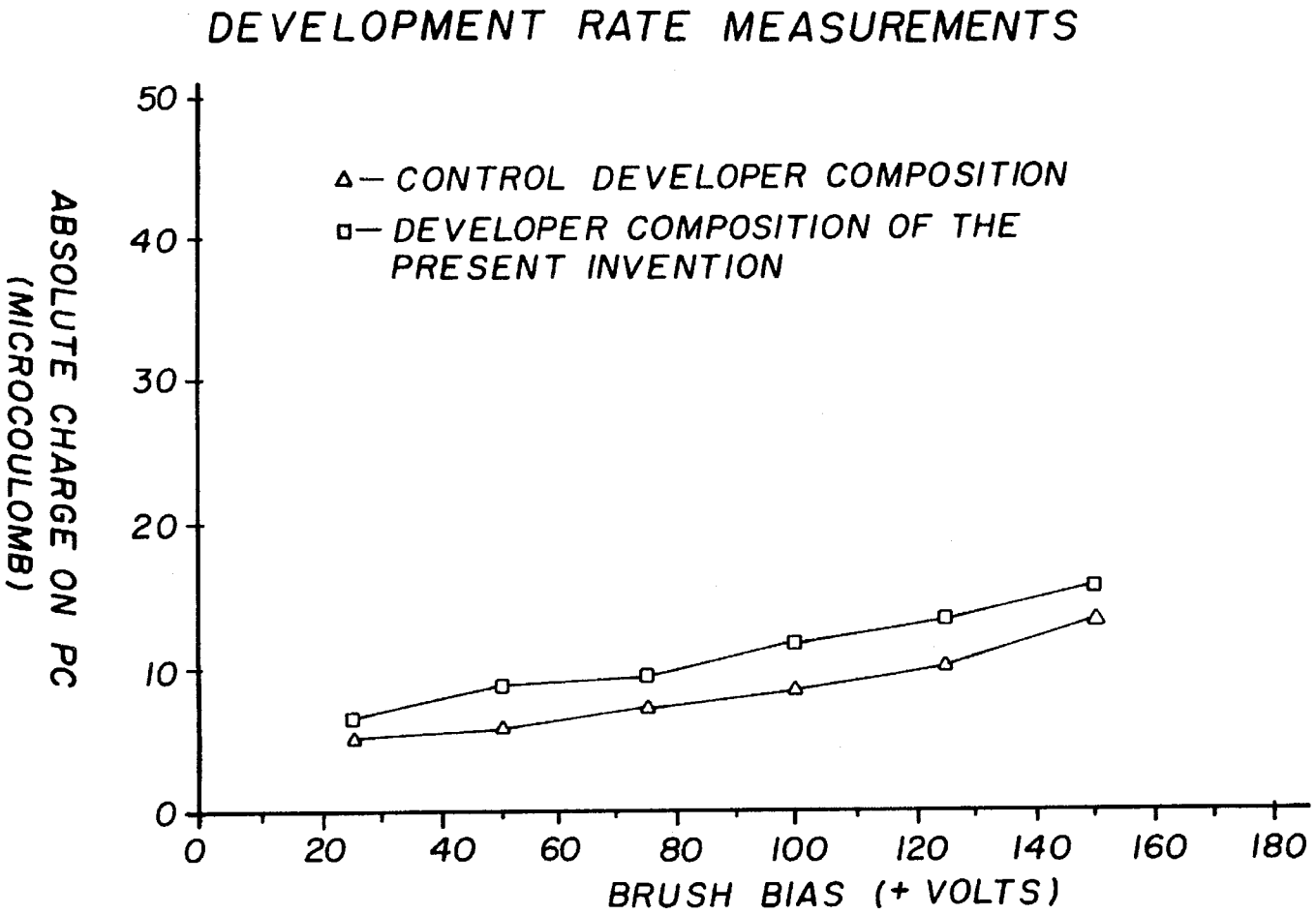
FIG. 1 is a graphical representation of the data set forth in Example 1, below.

As mentioned previously, when hard ferrite magnetic materials such as those materials having the formula $MO.6Fe_2O_3$ where M is strontium, barium or mixtures thereof as disclosed in U.S. Pat. Nos. 4,546,060 and 4,473,029 are used as carrier particles to form electrostatographic developer compositions comprising such charged carrier particles and oppositely charged toner particles, the speed of development is dramatically increased when the number average particle diameter of the carrier particles is limited to a range of from about 10.0 to about 38.0 micrometers as compared to developer compositions comprising the same carrier particles but having a conventional particle size distribution of from about 1.0 to about 60.0 micrometers as produced by the spray drying process.

While development speed is generally referred to in the prior art, a more meaningful term is to speak of "development efficiency." In a magnetic brush development system, development efficiency is defined as the potential difference between the photoreceptor in developed image areas before and after development divided by the potential difference between the photoreceptor and the brush prior to development times 100. Thus, for example, if the photoreceptor film voltage is −250 volts and the magnetic brush is −50 volts, the potential difference is −200 volts prior to development. If, during development, the film voltage is reduced by 100 volts to −150 volts in image areas by the deposition of positively charged toner particles, the development efficiency is (−100 volts: −200 volts) times 100 which gives an efficiency of development of 50 percent.

The carrier particles of this invention are prepared by conventional procedures that are well known in the art of making ferrites. Suitable procedures are described, for example, in U.S. Pat. Nos. 3,716,630, 4,623,603, and 4,042,518; K. Master, "Spray Drying Handbook", George Godwin Limited, London, 1979, and "Ferromagnetic Materials" Volume 3 edited by E. P. Wohlfarth and published by North Holland Publishing Company, Amsterdam, N.Y., page 315 et seq. For example, as mentioned previously, in the conventional spray drying process for producing strontium and barium ferrite carrier particles, powders of ferric oxide (i.e., $Fe_2O_3$) and the oxides of strontium or barium or a salt of strontium or barium convertible to the oxide by heat, such as the carbonates, sulfates, nitrates or phosphates of strontium or barium, are mixed together in the appropriate proportions, typically from about 4 to 6 moles of $Fe_2O_3$ per 1 mole of the metal oxide or metal oxide-forming salt, using an organic binder and a polar solvent (typically water) and spray-drying the mixture to form a fine, dry particulate. More particularly, a mixture of the ferrite-forming precursor materials or particles is mixed with a solution of an organic binder, such as guar gum, and water, ball milled into a liquid slurry and then spray dried to form unreacted, non-magnetic, dried green beads. Spray drying is the most commonly used technique to manufacture green beads. This technique is described in previously mentioned K. Masters, "Spray Drying Handbook," George Godwin Limited, London, 1979, which is hereby incorporated by reference.

During the ball milling process, a liquid slurry is produced containing the constituent raw materials. Extensive ball milling is required to achieve as intimate a mixture of the constituent ferrite-forming materials as possible. During spray drying, the solvent (e.g., water) in the liquid droplet is evaporated. In the dried droplet, the organic binder acts to bind the constituent ferrite-forming materials or particles together.

In order to keep the particles or powders well suspended in the aqueous media containing the organic binder, a small amount of surfactant, such as ammonium polymethacrylate or sodium polymethacrylate is typically added to the aqueous media. The concentration of the surfactant may be varied about 0.02 to about 0.04 percent by weight of the ferrite-forming solids in the slurry.

Guar gum is a natural product which has been widely used in industry because it is inexpensive, nontoxic, soluble in water and generally available. It also undergoes nearly complete combustion in the subsequent firing stage, leaving little residue in the magnetic ferrite carrier particles. Upon evaporation, these droplets form individual green beads of substantially uniform particle size and substantially spherical shape.

If desired, binder materials other than guar gum or gum arabic such as polyvinyl alcohol, dextrin, lignosulfonate and methyl cellulose can be used in the practice of the present invention.

In order to prepare the magnetic carrier particles, the green beads are subsequently fired at high temperatures generally ranging from 900° to 1500° C. During the firing process, the individual particulates within the individual green beads react to produce the desired crystallographic phase. Thus, during the firing process, the individual unreacted ferrite-forming precursor components bound in the non-magnetic green bead react to form the magnetic carrier particles, which, like the green beads, are of substantially uniform particle size and substantially spherical shape. The organic binder is degraded and is not present in the magnetic carrier particles. The magnetic character of the carrier particle is primarily controlled by the chemical stoichiometry of the constituting ferrite-forming materials and the processing conditions of reaction time and temperature. For optimum carrier performance, it is important that the chemical composition of the green beads be maintained throughout the spray drying process. The disintegration of green beads can result in chemically heterogeneous green bead particles, which will lead to less than optimum chemical reactions during the firing process and inferior magnetic performance of the final product.

Generally, a ball milling device which utilizes stainless steel balls is used to mix the ferrite-forming starting materials in slurry form. However, the ferrite-forming starting materials may be mixed in slurry form in any one of a number of types of equipment such as a vibrating pebble mill, a high speed stirrer with counter turning rotor and blades, an impeller mixer, a high speed dispersator, a high speed mixer or other conventional mixing equipment in lieu of a ball milling device. The actual degree of mixing achieved may be controlled by the choice of equipment used and the selection of specific equipment operating parameters and/or slurry conditions such as mixing speed, mixing time, viscosity and temperature. Where it is desired to obtain controlled particle size reduction during the mixing operation, then the choice of equipment will generally predominate. In the case of a ball milling device, a smooth, homogeneous slurry is generally formed after approximately 12 hours of agitation depending on the equipment capacity and the size of the batch prepared. Following the milling operation, it is generally preferred to screen the slurries prior to spray drying in order to eliminate any large, solid particles which may be present as would plug the atomizer.

A spray dryer designed for either spray nozzle atomization or spray machine-disc atomization or equivalent may be employed to dry the slurry of ferrite-forming starting materials. A particularly desirable type of spray machine is one that is essentially a closed pump impeller driven by a variable speed drive and is commonly termed a spinning atomizer, disc or wheel. A Niro Atomizer or Niro Spray Dryer (disc type) is especially useful.

Prior to firing the ferrite-forming green beads to obtain the ferrite carrier particles of the invention, the green beads are classified to obtain only that fraction of green beads having a number average particle diameter of from 10.0 to 38.0 micrometers. This insures that upon subsequent firing that only those ferrite carrier particles having a number average particle diameter of from 10.0 to 38.0 micrometers will be produced which is essential to the successful practice of the present invention.

"Number average particle size," as used herein, refers to the mean diameter of the particles as measured by a conventional particle size measuring device such as a Coulter Multisizer, sold by Coulter, Inc.

The ferrite carrier particles of this invention exhibit a high coercivity of at least 300 Oersteds, typically about 1000 to 3000 Oersteds, when magnetically saturated and an induced magnetic moment of at least 20 EMU/g of carrier in an applied field of 1000 Oersteds. Preferred particles have an induced magnetic moment of about 30 to about 70 EMU/g of carrier in an applied field of 1000 Oersteds. The induced magnetic moment of the carrier particles is dependent primarily on the composition and concentration of the magnetic material in the particle. A high coercivity is desirable as it results in better carrier flow on the brush, which results in a higher charge on the toner and more delivery of the toner to the photoconductor, which in turn translates into higher development speeds.

The coercivity of a magnetic material refers to the minimum external magnetic force necessary to reduce the induced magnetic moment from the remanence value to zero while it is held stationary in the external field and after the material has been magnetically saturated, i.e., the material has been permanently magnetized. A variety of apparatus and methods for the measurement of coercivity of the present carrier particles can be employed, such as a Princeton Applied Research Model 155 Vibrating Sample Magnetometer, available from Princeton Applied Research Co., Princeton, N.J. The powder is mixed with a nonmagnetic polymer powder (90% magnetic powder: 10% polymer by weight). The mixture is placed in a capillary tube, heated above the melting point of the polymer, and then allowed to cool to room temperature. The filled capillary tube is then placed in the sample holder of the magnetometer and a magnetic hysteresis loop of external field (in Oersteds) versus induced magnetism (in EMU/g) is plotted. During this measurement, the sample is exposed to an external field of 0 to 10,000 Oersteds.

Although uncoated ferrite carrier particles can be used in the developer compositions described herein, it is often desirable to resin-coat the particles with a polymer, as is well known in the art, to better enable the carrier particles to triboelectrically charge the toner particles. When a resin-coated carrier is used, the toner particles acquire an optimally high, net electrical charge because of the frictional contact of the toner particles and the resin coating. The high net charge reduces the amount of toner lost from the developer mix as it is agitated in the magnetic brush apparatus.

The resin in which the carrier particles are coated can be any of a large class of thermoplastic polymeric resins. Especially desirable are fluorocarbon polymers such as poly(vinylidene fluoride) and poly(vinylidene fluoride-co-tetra-fluoroethylene). Also useful are the copolymers of vinylidene chloride with acrylic monomers which are disclosed in U.S. Pat. No. 3,795,617. Other examples include cellulose esters such as cellulose acetate and cellulose acetate butyrate, polyesters such as poly(ethylene terephthalate) and poly(1,4-butanediol terephthalate), polyamides such as nylon and polycarbonates, polyacrylates and polymethacrylates. Still other examples include the thermosetting resins and light-hardening resins described in U.S. Pat. No. 3,632,512; the alkali-soluble carboxylated polymers of U.S. Pat. No. Re. 27,912 (Reissue of U.S. Pat. No. 3,547,822); and the ionic copolymers of U.S. Pat. Nos. 3,795,618 and 3,898,170.

In coating the ferrite carrier particles with resin, the carrier particles are mixed with finely-divided powdered resin. The particle size of the powdered resin can vary considerably but should be smaller than the particle size of the carrier particles. The resin particles can range in average diameter from 0.01 to 5.0 micrometers.

The amount of resin powder relative to the amount of carrier particles can vary over a considerable range, but preferably, is from 0.05 to 5 weight percent. By using such a small amount of resin, it is possible to form a discontinuous resin coating or a very thin resin coating on the ferrite particles and retain good conductivity in accordance with the invention.

To dry-mix the carrier particles and resin particles, they preferably are tumbled together in a rotating vessel. This dry mixing should continue preferably for several minutes, e.g., for 5 to 30 minutes. Other methods of agitation of the particles are also suitable, e.g., mixing in a fluidized bed with an inert gas stream, or mixing by a mechanical stirrer.

After dry mixing the carrier particles and resin powder as described, the resin is bonded to the carrier particles, for example, by heating the mixture in an oven at a temperature and for a time sufficient to achieve bonding.

As discussed previously, the carrier particles of the invention are employed in combination with toner particles to form a dry, two-component developer composition. In use, the toner particles are electrostatically attracted to the electrostatic charge pattern on an element while the carrier particles remain on the applicator shell. This is accomplished in part by intermixing the carrier and toner particles so that the carrier particles acquire a charge of one polarity and the toner particles acquire a charge of the opposite polarity. The charge polarity on the carrier is such that it will not be electrically attracted to the electrostatic charge pattern. The carrier particles also are prevented from depositing on the electrostatic charge pattern because the magnetic attraction exerted between the rotating core and the carrier particles exceeds the electrostatic attraction which may arise between the carrier particles and the charge image.

Tribocharging of toner and hard magnetic carrier is achieved by selecting materials that are so positioned in the triboelectric series to give the desired polarity and magnitude of charge when the toner and carrier particles intermix. If the carrier particles do not charge as desired with the toner employed, the carrier can be coated with a material which does. Such coating materials and methods have been previously described herein. The charging level in the toner generally is at least 3.0 to 5.0 microcoulombs per gram of toner weight, although charging levels of up to 10 to about 150 microcoulombs per gram of toner can be used. At such charging levels, the electrostatic force of attraction between toner particles and carrier particles is sufficient to disrupt the magnetic attractive forces between carrier particles, thus facilitating replenishment of the developer with fresh toner. How these charging levels are measured is described immediately below. The polarity of the toner charge can be either positive or negative.

The charging level or charge-to-mass ratio on the toner, Q/M, in microcoulombs/gram, is measured using a standard procedure in which the toner and carrier are placed on a horizontal electrode beneath a second horizontal electrode and are subjected to both an AC magnetic field and a DC electric field. When the toner jumps to the other electrode change in the electric charge is measured and divided by the weight of toner that jumped. It will be appreciated, in this regard, that the carrier will bear about the same charge as, but opposite in polarity to, that of the toner.

The developer is formed by mixing the particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 percent carrier and from about 25 to 1 weight percent toner.

The toner component of the invention can be a powdered resin which is optionally colored. It normally is prepared by compounding a resin with a colorant, i.e., a dye or pigment, and any other desired addenda. If a developed image of low opacity is desired, no colorant need be added. Normally, however, a colorant is included and it can, in principle, be any of the materials mentioned in Colour Index, Vols. I and II, 2nd Edition. Carbon black is especially useful. The amount of colorant can vary over a wide range, e.g., from 3 to 20 weight percent of the polymer. Combinations of colorants may be used.

The mixture is heated and milled to disperse the colorant and other addenda in the resin. The mass is cooled, crushed into lumps and finely ground. The resulting toner particles range in diameter from 0.5 to 5.0 micrometers.

The toner resin can be selected from a wide variety of materials, including both natural and synthetic resins and modified natural resins, as disclosed, for example, in the patent to Kasper et al, U.S. Pat. No. 4,076,857 issued Feb. 28, 1978. Especially useful are the crosslinked polymers disclosed in the patent to Jadwin et al, U.S. Pat. No. 3,938,992 issued Feb. 17, 1976, and the patent to Sadanatsu et al, U.S. Pat. No. 3,941,898 issued Mar. 2, 1976. The crosslinked or noncrosslinked copolymers of styrene or lower alkyl styrenes with acrylic monomers such as alkyl acrylates or methacrylates are particularly useful. Also useful are condensation polymers such as polyesters.

The shape of the toner can be irregular, as in the case of ground toners, or spherical. Spherical particles are obtained by spray drying a solution of the toner resin in a solvent. Alternatively, spherical particles can be prepared by the polymer bead swelling technique disclosed in European Pat. No. 3905 published Sep. 5, 1979, to J. Ugelstad.

The toner can also contain minor components such as charge control agents and antiblocking agents. Especially useful charge control agents are disclosed in U.S. Pat. No.

3,893,935 and British Pat. No. 1,501,065. Quaternary ammonium salt charge agents are disclosed in Research Disclosure, No. 21030, Volume 210, October, 1981 (published by Industrial Opportunities Ltd., Homewell, Havant, Hampshire, P09 1EF, United Kingdom), are also useful.

Developers including the ferrite carrier particles of this invention having a number average particle diameter of from 10.0 to 38.0 micrometers exhibit a dramatic increase in development speeds or efficiencies when compared to ferrite carrier particles made from the same materials and having the same consistency but having a much wider particle size distribution (i.e., from about 1.0 to 60.0 micrometers).

In the method of the present invention, an electrostatic image is brought into contact with a magnetic brush comprising a rotating-magnetic core, an outer non-magnetic shell and a two-component, dry developer described above. The electrostatic image so developed can be formed by a number of methods such as by image-wise photodecay of a photoreceptor, or image-wise application of a charge pattern on the surface of a dielectric recording element. When photoreceptors are employed, such as in high-speed electrophotographic copy devices, the use of half tone screening to modify an electrostatic image can be employed, a combination of screening with development producing high-quality images exhibiting high $D_{max}$ and excellent tonal range. Representative screening methods including those employing photoreceptors with integral half-tone screens are disclosed in U.S. Pat. No. 4,385,823.

The following non-limiting example further illustrates the invention.

EXAMPLE 1

The development efficiency or speed of development of a developer composition of the invention comprising carrier particles made of strontium ferrite and having a particle size distribution of from 10.0 to 38.0 micrometers (number average particle diameter) was determined by forming a two-component developer composition comprising 2.0 percent by weight of a cyan pigmented polyester toner having a number average particle diameter of 3.0 to 5.0 micrometers and a toner charge of 135 microconlombs per gram of toner and 98.0 percent by weight of strontium ferrite carrier particles having a number average particle diameter of 10.0 to 38.0 micrometers thinly coated with a fluorocarbon resin (Kynar 301 fluorocarbon polymer obtained from the Pennwalt Chemical Company, King of Prussia, Pa.).

The charge on the toner is microcoulombs/g, Q/M, was measured using the previously mentioned procedure in which the toner and the carrier were placed on a horizontal electrode and subjected to both an AC magnetic field and a DC electric field. When the toner jumped to the other electrode, the change in the electrical charge was measured and was divided by the weight of the toner that jumped.

A control developer also was prepared for comparison consisting of 98.0 percent by weight of the same strontium ferrite carrier particles as described above and 2.0 percent by weight of the same cyan pigmented polyester toner as described above having a number average particle diameter of 3.0 to 5.0 micrometers and a toner charge of 135 microcoulombs per gram of toner except that the particle size distribution (i.e., number average particle diameter) of the carrier particles was from 10.0 to 60.0 micrometers which is representative of a typical particle size distribution conventionally used in developer compositions.

After shaking in separate glass vials for two minutes, the developer compositions prepared as described above were applied to a multi-active organic photoconductor element maintained at zero potential mounted on an aluminum base which acted as a ground using a rotating-core magnetic applicator housed on a linear breadboard device. The magnetic applicator included a 5.08 cm out side diameter, non-magnetic stainless steel shell 15.24 cm in axial length. A core containing ten alternating pole magnets was enclosed in the shell which produced a magnetic field of 900–1000 Oarsteds on the shell surface. The tests were made while rotating the core of magnets at 2000 revolutions per minute. The shell of the magnetic brush was kept stationary. Developer was distributed on the shell from a feed hopper and traveled clockwise around the shell. A direct current power supply applied a constant bias on the magnetic brush in a range of +25 volts to +175 volts. A charge measuring device (i.e., an electrometer) was attached to the photoconductor. The developers were positively charging (i.e., the charge on the toner was positive). Since the toner is positive charging, the positive bias on the brush induces a repulsive force on the toner. And, since the photoconductor is kept at a zero potential, an attractive force is generated between the toner and the photoconductor and the toner migrates from the brush to the photoconductor due to this force. The charge of the toner induces charge accumulation on the photoconductor during its passage over the brush and is recorded by the electrometer. A higher value of charge accumulated on the photoconductor as measured by the electrometer indicates a higher development rate of speed as compared to a developer producing a lower charge on the photoconductor under the same conditions of operation. In the present test, the rate of development of the two developer compositions described above was measured by measuring the charge on the photoconductor at discrete voltage values of bias while the photoconductor was traversing over the magnetic brush at a constant linear velocity of 12.54 cm per second. The results are shown in the FIG. 1.

As FIG. 1 clearly shows, the rate of development or development efficiency was much higher using a developer composition of the present invention as compared to a similar developer composition having a conventional carrier particle size distribution.

The invention has been described in detail with particular reference to preferred embodiments thereof, but it will be understood that variations and modifications can be effected within the spirit and scope of the invention.

We claim:

1. A carrier for an electrostatographic developer comprising particles of a hard magnetic ferrite material having a hexagonal crystalline structure of the general formula MO.6 $Fe_2O_3$ in which M is strontium, barium or mixtures thereof exhibiting a coercivity of at least 300 Oersteds when magnetically saturated and an induced magnetic moment of at least 20 EMU/g when in an applied magnetic field of 1000 Oersteds and having a number average particle diameter of from 10.0 to 38.0 micrometers.

2. A carrier according to claim 1, wherein said particles are generally spherical.

3. A carrier according to claim 1, wherein said particles are coated with a discontinuous tribocharging resin layer.

4. An electrostatographic two-component dry developer composition for use in the development of electrostatic latent images which comprises a mixture of charged toner particles and oppositely charged carrier particles which comprise a hard magnetic ferrite material having a hexagonal crystalline structure of the general formula MO.6 $Fe_2O_3$ in which M is strontium, barium or mixtures thereof exhibiting a coercivity of at least 300 Oersteds when magnetically saturated and an induced magnetic moment of at least 20 EMU/g when in an applied magnetic field of 1000 Oersteds and having a number average particle diameter of from 10.0 to 38.0 micrometers.

5. An electrostatographic developer comprising from about 75 to about 99 weight percent of a carrier according to claim 1, and from about 1 to about 25 weight per cent of a toner.

* * * * *